US006273341B1

(12) United States Patent
Debabi

(10) Patent No.: US 6,273,341 B1
(45) Date of Patent: Aug. 14, 2001

(54) NON-DERAILABLE TRAIN SYSTEM INCLUDING A MOVABLE CROSSING PLATFORM

(76) Inventor: Ahmed Debabi, 18 Burnside Avenue #602, Ottawa, Ontario (CA), K1Y 4V7

( * ) Notice: Subject to any disclaimer, the term of this patent is extended or adjusted under 35 U.S.C. 154(b) by 0 days.

(21) Appl. No.: 09/534,485

(22) Filed: Mar. 24, 2000

(51) Int. Cl.[7] ..... E01B 25/00

(52) U.S. Cl. ..... 238/8; 238/2; 238/10 R; 104/126; 104/130.7; 104/242; 105/238.1

(58) Field of Search ..... 238/10 R, 10 A, 238/10 F, 13, 122 R, 130, 131, 2, 8; 104/124, 126, 130.07, 242, 245, 247; 188/43, 33, 41, 35; 105/238.1

(56) References Cited

U.S. PATENT DOCUMENTS

| | | | | |
|---|---|---|---|---|
| Re. 32,106 | * | 4/1986 | Lemelson | 446/138 |
| D. 376,460 | | 12/1996 | Isaia et al. . | |
| 426,877 | * | 4/1890 | Stream | 238/10 A |
| 1,758,093 | * | 5/1930 | Thorn | 238/10 MR |
| 3,143,081 | | 8/1964 | Dolphin et al. . | |
| 3,403,251 | * | 9/1968 | Pale et al. | 238/10 R |
| 3,648,617 | | 3/1972 | Metzner . | |
| 3,860,171 | * | 1/1975 | Mastronardi | 238/304 |
| 4,485,967 | * | 12/1984 | Edwards | 238/226 |
| 4,665,833 | * | 5/1987 | Fleishman et al. | 104/301 |
| 4,779,537 | | 10/1988 | Hafner et al. . | |
| 4,965,940 | * | 10/1990 | Wilson | 33/651.1 |
| 5,024,163 | * | 6/1991 | Lenz | 105/73 |
| 5,119,737 | * | 6/1992 | Thorsen | 105/163.2 |
| 5,439,281 | * | 8/1995 | Crocker | 312/201 |
| 5,657,699 | | 8/1997 | Bishop . | |
| 5,662,515 | * | 9/1997 | Evensen | 451/59 |
| 5,829,357 | * | 11/1998 | Coppens | 105/572.2 |
| 6,155,176 | * | 12/2000 | Checketts | 104/53 |

FOREIGN PATENT DOCUMENTS

| | | | | |
|---|---|---|---|---|
| 1102699 | * | 7/1984 | (AU) | 188/43 |
| 3122421 | * | 12/1982 | (GB) | 188/43 |

* cited by examiner

*Primary Examiner*—S. Joseph Morano
*Assistant Examiner*—Frantz F. Jules

(57) ABSTRACT

A non-derailable train system including a movable crossing platform for preventing train derailments. The non-derailable train system including a movable crossing platform includes spaced tracks having a rounded upper surface, train wheels having a concave outer perimeter wall complimentary to the rounded upper surface of the tracks for preventing lateral removal of the wheels from the tracks. Also included is a movable platform system for facilitating crossing of the tracks by other vehicles.

14 Claims, 10 Drawing Sheets

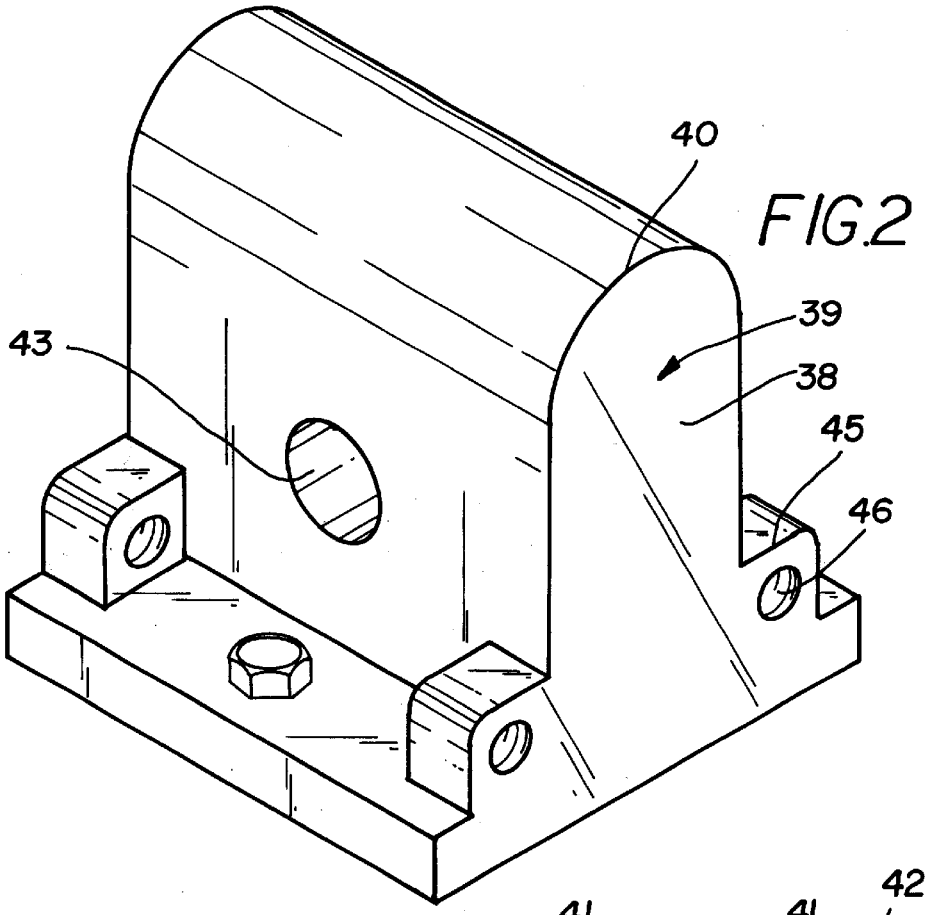
FIG.2
FIG.3
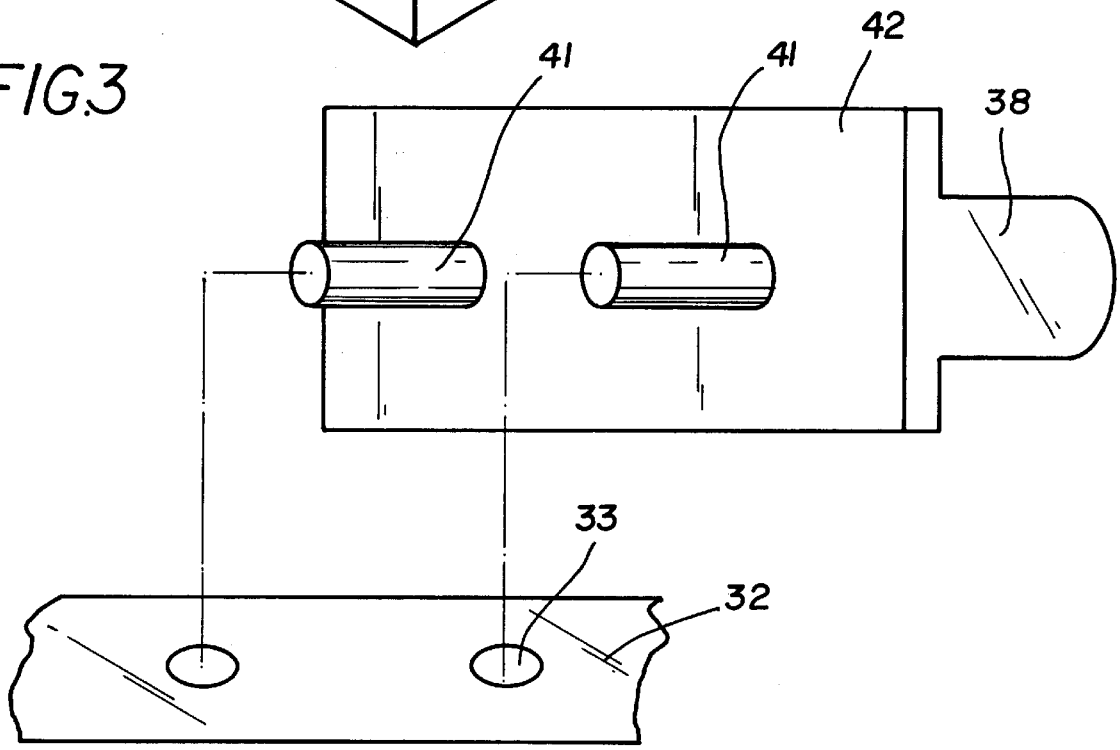

52
52
56
57
34
33
33
32
32
32
33
35
30
36

NON-DERAILABLE TRAIN SYSTEM INCLUDING A MOVABLE CROSSING PLATFORM

BACKGROUND OF THE INVENTION

1. Field of the Invention

The present invention relates to train derailment prevention systems and more particularly pertains to a new non-derailable train system including a movable crossing platform for preventing train derailments.

2. Description of the Prior Art

The use of train derailment prevention systems is known in the prior art. More specifically, train derailment prevention systems heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 5,024,163; 4,779,537; 3,648,617; 5,657,699; 3,143,081; and 376,460.

While these devices fulfill their respective, particular objectives and requirements, the aforementioned patents do not disclose a new non-derailable train system including a movable crossing platform. The inventive device includes spaced tracks having a rounded upper surface, train wheels having a concave outer perimeter wall complimentary to the rounded upper surface of the tracks for preventing lateral removal of the wheels from the tracks. Also included is a movable platform system for facilitating crossing of the tracks by other vehicles.

In these respects, the non-derailable train system including a movable crossing platform according to the present invention substantially departs from the conventional concepts and designs of the prior art, and in so doing provides an apparatus primarily developed for the purpose of preventing train derailments.

SUMMARY OF THE INVENTION

In view of the foregoing disadvantages inherent in the known types of train derailment prevention systems now present in the prior art, the present invention provides a new non-derailable train system including a movable crossing platform construction wherein the same can be utilized for preventing train derailments.

The general purpose of the present invention, which will be described subsequently in greater detail, is to provide a new non-derailable train system including a movable crossing platform apparatus and method which has many of the advantages of the train derailment prevention systems mentioned heretofore and many novel features that result in a new non-derailable train system including a movable crossing platform which is not anticipated, rendered obvious, suggested, or even implied by any of the prior art train derailment prevention systems, either alone or in any combination thereof.

To attain this, the present invention generally comprises spaced tracks having a rounded upper surface, train wheels having a concave outer perimeter wall complimentary to the rounded upper surface of the tracks for preventing lateral removal of the wheels from the tracks. Also included is a movable platform system for facilitating crossing of the tracks by other vehicles.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new non-derailable train system including a movable crossing platform apparatus and method which has many of the advantages of the train derailment prevention systems mentioned heretofore and many novel features that result in a new non-derailable train system including a movable crossing platform which is not anticipated, rendered obvious, suggested, or even implied by any of the prior art train derailment prevention systems, either alone or in any combination thereof.

It is another object of the present invention to provide a new non-derailable train system including a movable crossing platform that may be easily and efficiently manufactured and marketed.

It is a further object of the present invention to provide a new non-derailable train system including a movable crossing platform that is of a durable and reliable construction.

An even further object of the present invention is to provide a new non-derailable train system including a movable crossing platform which is susceptible of a low cost of manufacture with regard to both materials and labor, and which accordingly is then susceptible of low prices of sale to the consuming public, thereby making such non-derailable train system including a movable crossing platform economically available to the buying public.

Still yet another object of the present invention is to provide a new non-derailable train system including a movable crossing platform which provides in the apparatuses and methods of the prior art some of the advantages thereof, while simultaneously overcoming some of the disadvantages normally associated therewith.

Still another object of the present invention is to provide a new non-derailable train system including a movable crossing platform for preventing train derailments.

Yet another object of the present invention is to provide a new non-derailable train system including a movable crossing platform which includes spaced tracks having a rounded upper surface, train wheels having a concave outer perimeter wall complimentary to the rounded upper surface of the tracks for preventing lateral removal of the wheels from the tracks. Also included is a movable platform system for facilitating crossing of the tracks by other vehicles.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 2 is a perspective view of a single track piece of the present invention.

FIG. 3 is a bottom perspective view of a single track piece of the present invention.

DESCRIPTION OF THE PREFERRED EMBODIMENT

Figure 8:
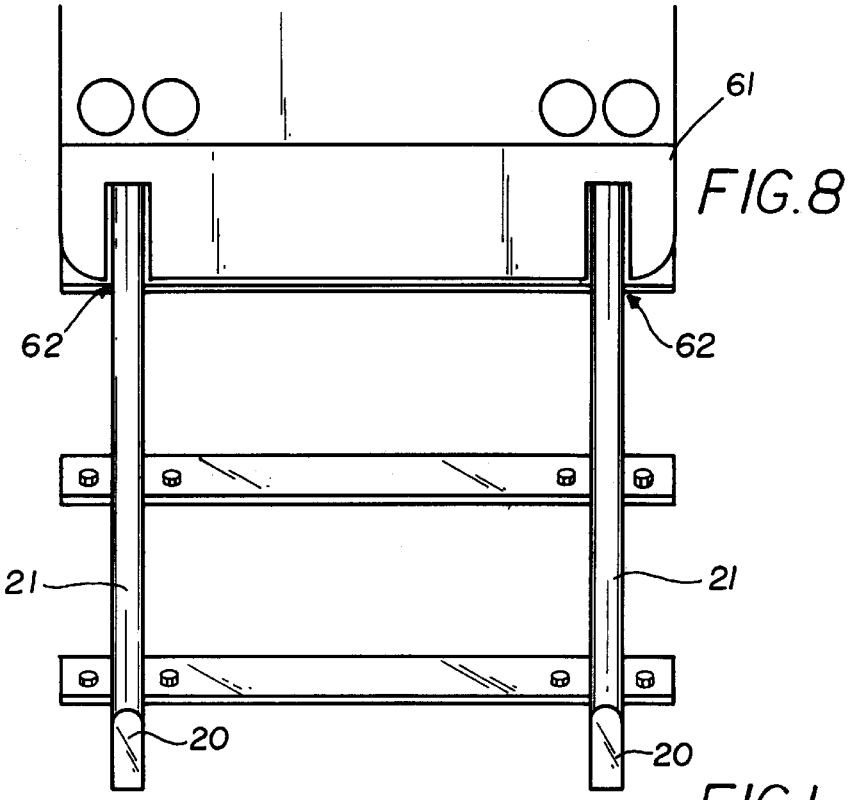
FIG. 8 is a front perspective view of the present invention.
Figure 1:
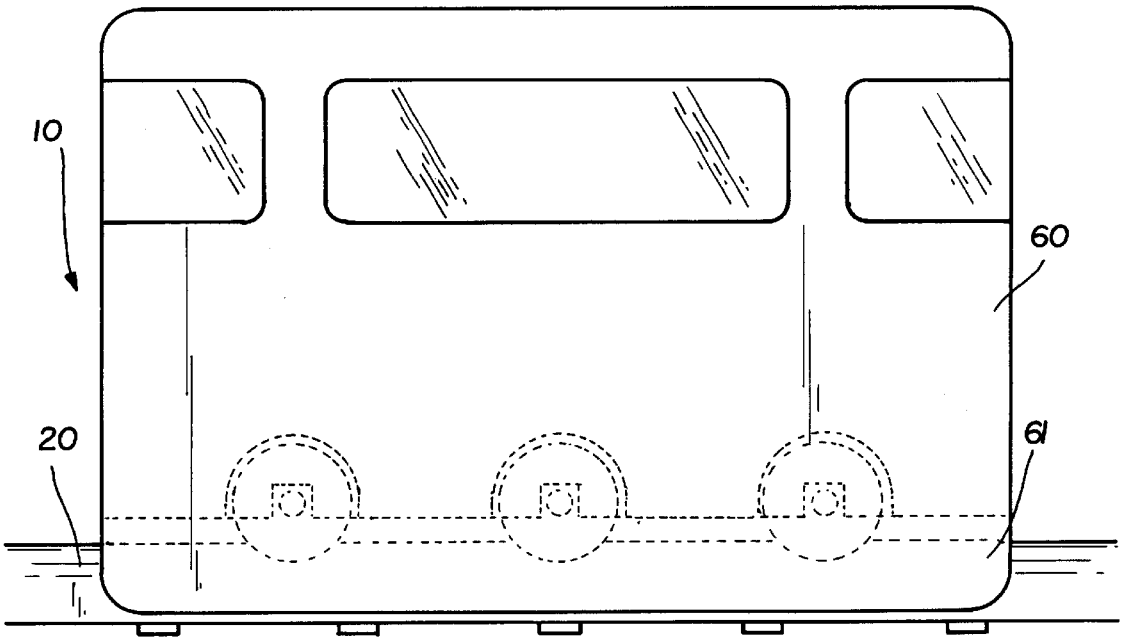
FIG. 1 is a side view of a new non-derailable train system including a movable crossing platform according to the present invention.
Figure 4:
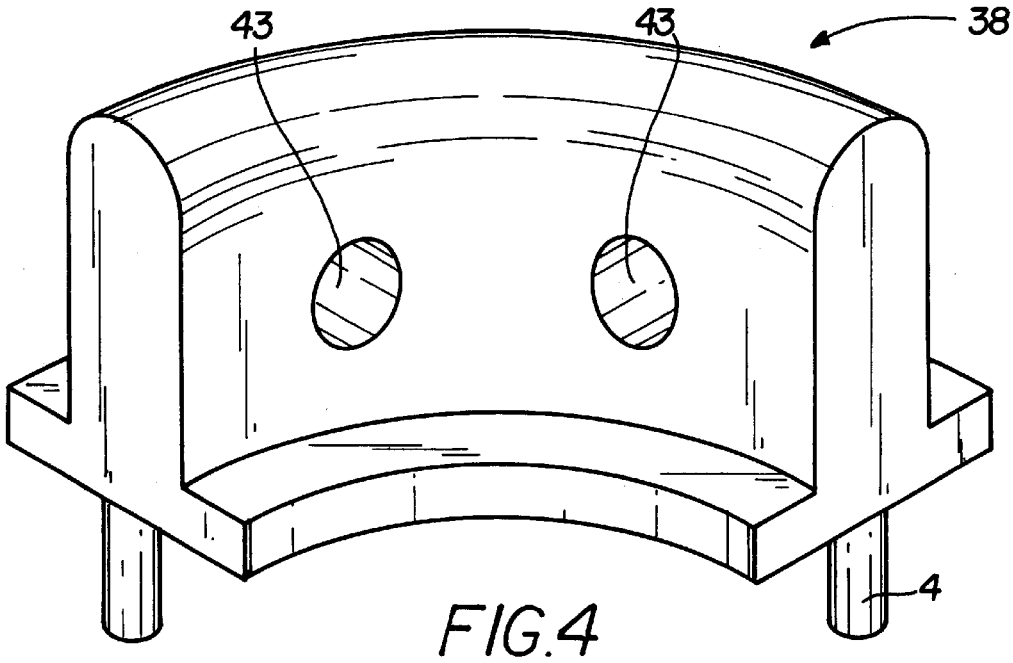
FIG. 4 is a perspective view of a curved single track piece of the present invention.
Figure 5:
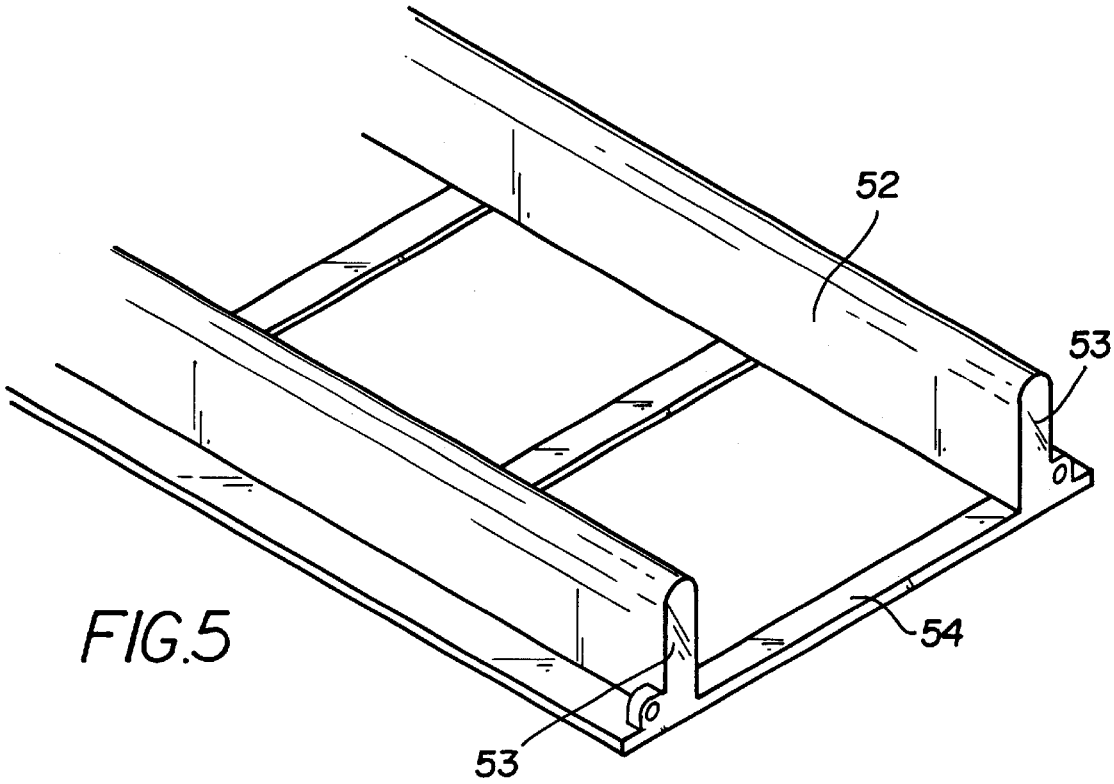
FIG. 5 is a perspective view of a double track piece of the present invention.
Figure 6:
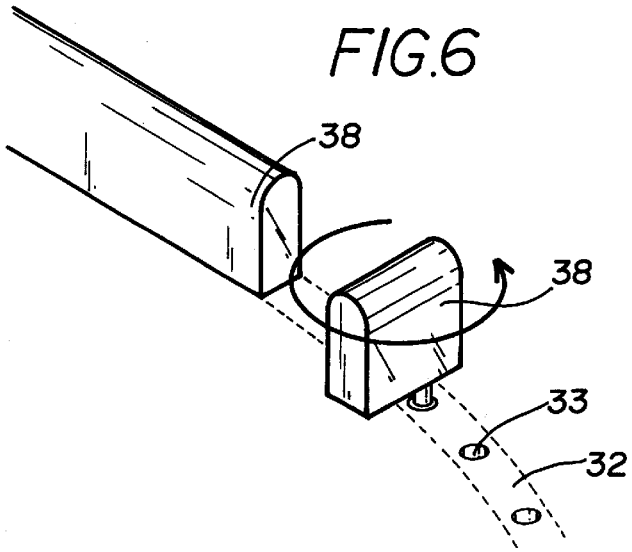
FIG. 6 is a front perspective view of a rotatable single track piece of the present invention.
Figure 7:
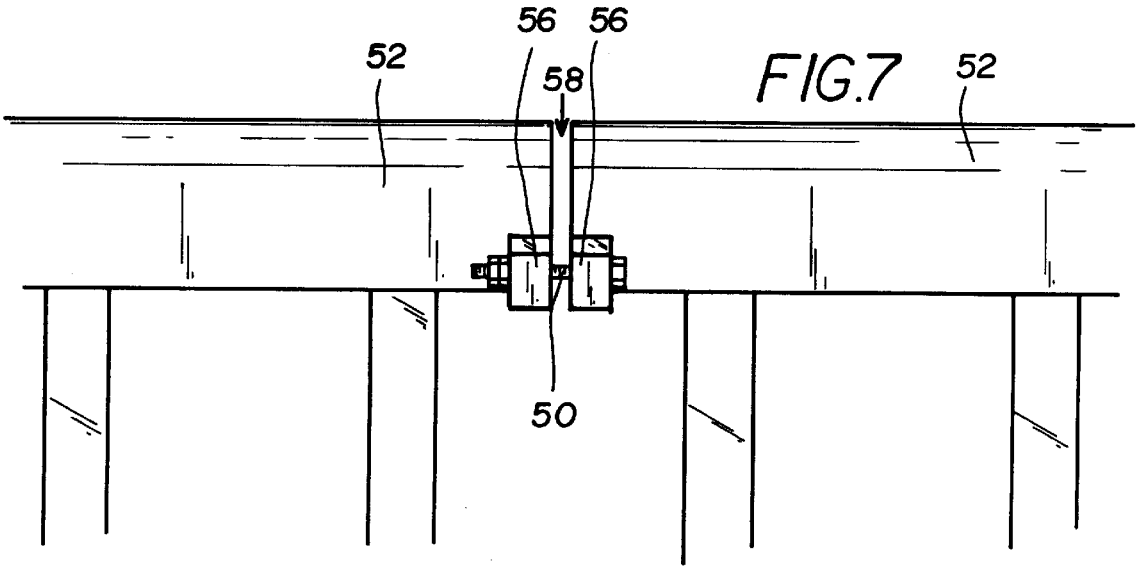
FIG. 7 is a top view of a connection between adjacent track pieces.
Figure 9:
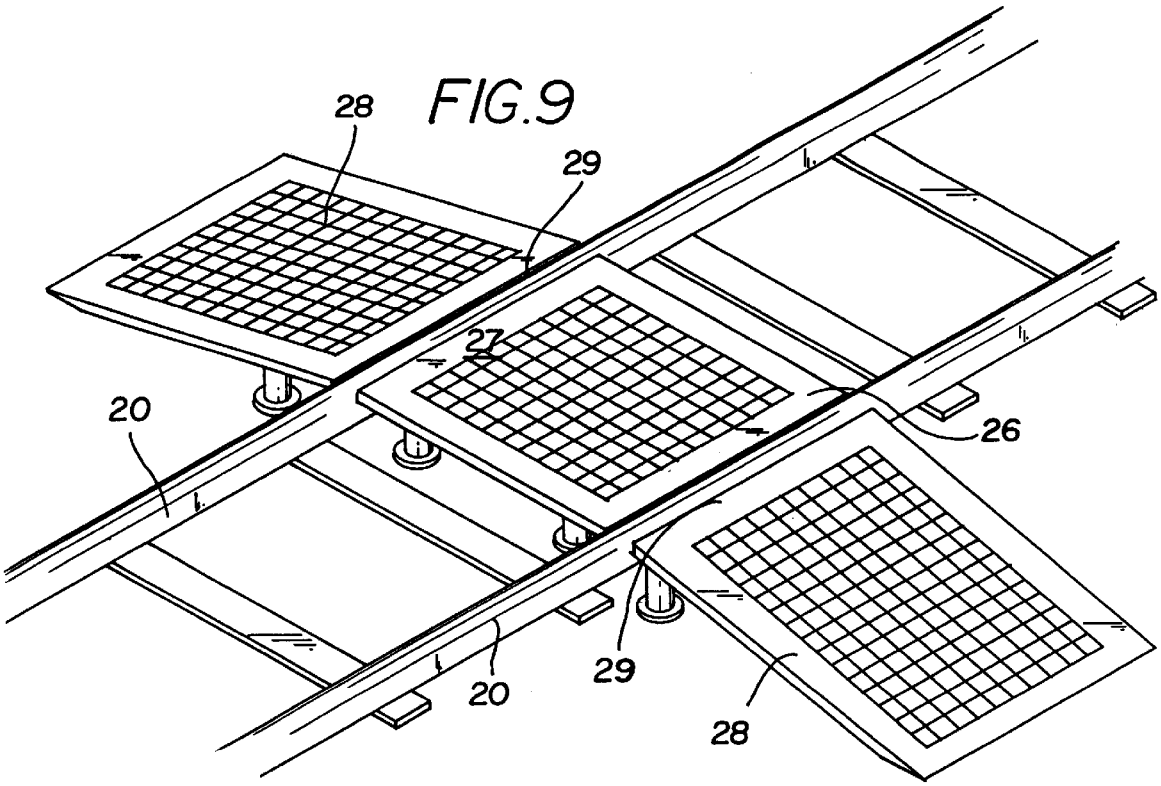
FIG. 9 is a perspective view of the movable crossing platform of the present invention.
Figure 10:
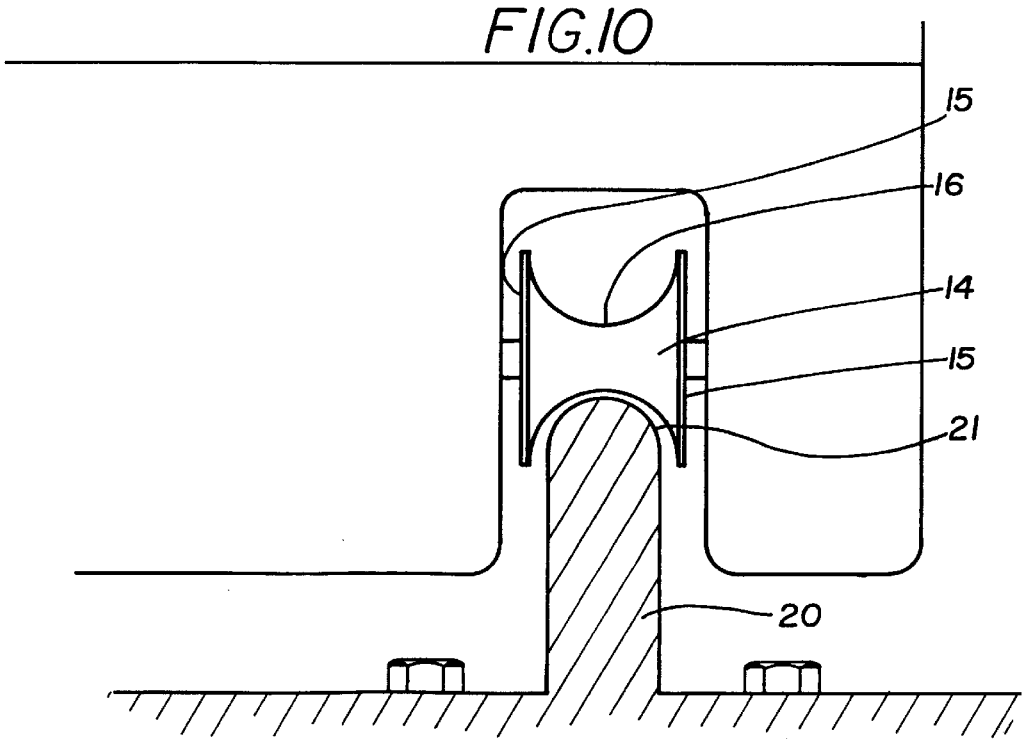
FIG. 10 is a front view of the wheel track connection of the present invention.
Figure 11:
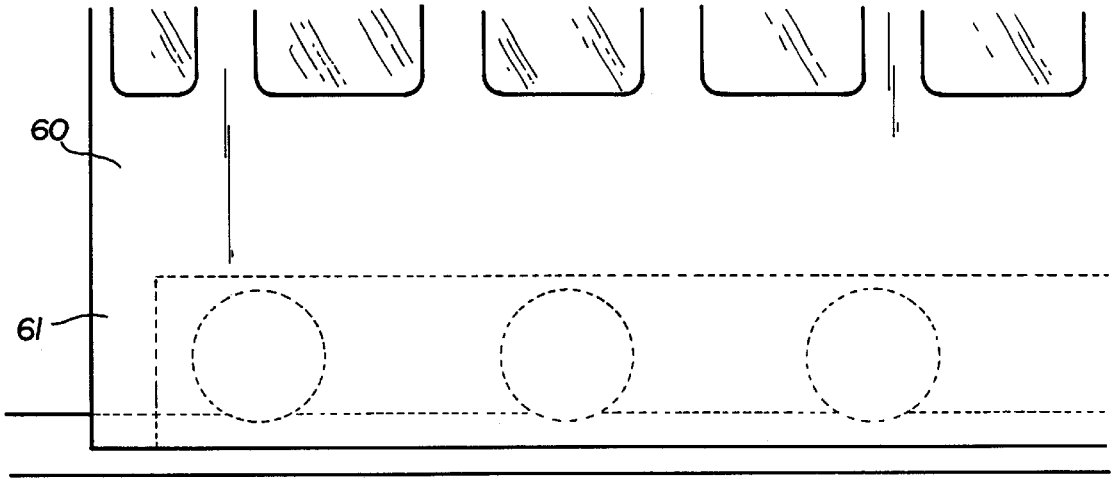
FIG. 11 is a side view of the present invention.

With reference now to the drawings, and in particular to FIGS. 1 through 16 thereof, a new non-derailable train system including a movable crossing platform embodying the principles and concepts of the present invention and generally designated by the reference numeral 10 will be described.

As best illustrated in FIGS. 1 through 16, the non-derailable train system including a movable crossing platform 10 generally comprises a train 12 having a plurality of wheels 14. Each wheel is generally disc shaped and includes opposite sides 15 and an outer perimeter wall 16 extending between the opposite sides. The outer perimeter wall of each wheel is arcuate such that the outer perimeter wall of each wheel is concave.

The system 10 includes a pair of spaced tracks 20. Each track includes a convex upper surface 21 insertable into the concave outer perimeter wall of each wheel whereby the wheel is prevented from moving laterally with respect to the track to prevent derailing of the train.

The wheels are divided into a first set 23 of wheels and a second set 24 of wheels. Each set of wheels 23 and 24 is aligned along a respective side of the train such that each set of wheels engages a respective one of the tracks when the train is positioned on the track.

For areas where streets cross the train tracks, the height of each track is designed to prevent vehicles from readily crossing the tracks to prevent accidental obstruction of the tracks. The system 10 provides a safe crossing method requiring an inner platform member 26 having a substantially planar upper surface 27. The inner platform member is designed for positioning between the tracks. A pair of outer platform members 28 is included, the outer platform members being positioned on opposite outer sides of the pair of tracks and in alignment with the inner platform member. The inner platform member is designed for elevating above a ground surface to a height such that the upper surface of the inner platform is positioned substantially in a plane extending between the upper surfaces of the tracks. The outer platforms each include an interior edge 29 positioned adjacent to a respective one of the tracks. The interior edge is designed for being selectively elevated above the ground surface such that the interior edge of the outer platform is positioned adjacent to the upper surface of the respective track. Thus, the upper surface of the outer platform extends between the ground or street surface and the upper surface of the respective track for facilitating movement of a vehicle over the tracks. Thus, the platforms may be raised to permit traffic to pass over the tracks when a train is not approaching the street.

The tracks include switching portions 30 to permit movement of the train from one set of tracks to another. The switching portion includes a plurality of base members 32 positioned substantially level with the ground. Each of the base members includes at least one aperture 33 therein. In an example, the base members are arranged to define a first straight pair of parallel members 34, a second pair of parallel members 35 diverging from the first pair of parallel members in a first direction, and a third pair of parallel members 36 diverging from the first parallel members in a second direction opposite the first direction. In use, a switching portion may of course provide only one diverging set of tracks when only one alternate direction of travel is desired.

The track switching portion also includes a plurality of single track pieces 38. Each of the single track pieces includes an upper portion 39 having a convex upper surface 40 insertable into the concave outer perimeter wall of each wheel. Each of the single track pieces further includes at least one protrusion 41 extending downwardly from a bottom surface 42 of the single track piece for insertion into the apertures of the base members such that the single track pieces are selectively arrangeable to define a single parallel pair of switching tracks extending between tracks along a desired path of travel. As seen if FIG. 6, a single track piece may have a single protrusion to facilitate turning of the piece without having to fully remove the piece from the base member. A lifting hole 43 is provided for extending through the upper portion of the single track piece. The lifting hole is designed for permitting insertion of a tool such as a hook or other lifting device through the lifting hole for facilitating movement of the single track piece to a different location in the track switching portion.

Each single track piece also includes a plurality of connection portions 45. Each connection portion includes a generally cylindrical connection hole 46 extending through the connection portion. Each connection hole is positioned to have a longitudinal axis extending parallel to a longitudinal axis of the upper portion of the track piece. The connection portions are alignable with connection portions of an adjacently positioned single track piece for facilitating connection of the single track pieces by coupling a connecting member 50 through the aligned connection holes whereby the adjacent single track pieces are coupled together.

Figure 16:
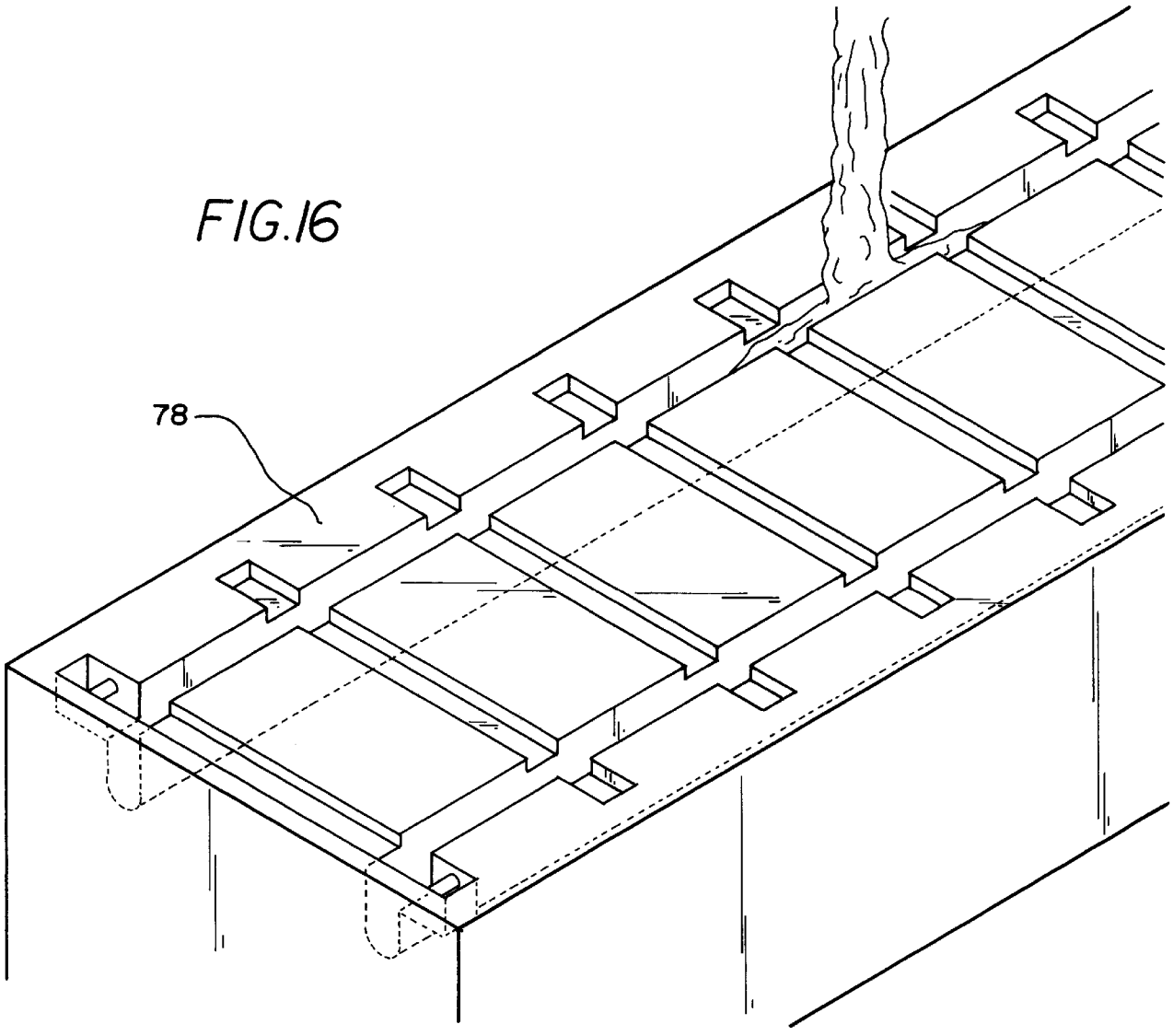
FIG. 16 is a perspective view of the casting of a double track piece of the present invention.

In non-switching areas, the spaced tracks include a plurality of double track pieces 52. The double track pieces include a pair of upper portions 53 having similar structure to the upper portions 39. The upper track portions of the double track pieces are coupled to each other by a plurality of spacing cross members 54 integrally joined to the upper portions. Each double track piece also includes a plurality of connection portions 56, each connection portion includes a generally cylindrical connection hole 57 extending through the connection portion 56. Each connection hole is positioned to have a longitudinal axis extending parallel to a longitudinal axis of an associated one of the upper portions of the double track piece. The connection portions 56 are alignable with connection portions 56 of an adjacently positioned double track piece for facilitating connection of the double track pieces by coupling a connecting member 50 through the aligned connection holes 57 whereby the adjacent double track pieces are coupled together. In use, the adjacent double track pieces are aligned and coupled to each other such that a gap 58 is formed between the adjacent double track pieces to permit expansion of the double track pieces due to changing temperature. As shown in FIG. 16, the double track pieces may be formed using a mold 78 for casting of the double track pieces.

In an embodiment, each train includes at least one car 60. Each car includes six wheels, three wheels positioned on each side of the car. The car also includes an outer housing 61. The outer housing extends downwardly on opposite sides of each wheel to form a pair of wheel slots 62 extending along a length of the car. The wheels are positioned within the wheel slots such that the outer housing extends below the outer perimeter wall of the wheels whereby the wheel slots receive a distal portion 63 of the upper portion 39 or 53 of the tracks when the train is positioned on the tracks.

In an embodiment, the train also includes a brake assembly 65 coupled to each side of the outer housing. Each brake assembly includes a hydraulic piston 66 coupled to a bracket member 67. The bracket member is coupled to the outer housing. A brake arm 68 is pivotally coupled to the bracket member and includes a brake pad 69 coupled to a first end 70 of the brake arm. The brake pad is positioned proximate the upper portion of an associated one of the tracks when the train is positioned on the tracks. A second end 71 of the brake arm is engaged to an extendable head 72 of the hydraulic piston such that extension of the head of the piston pivots the brake pad into contact with the upper portion of the associated track for slowing the train. In an embodiment, each brake assembly further includes a biasing assembly 74 coupled to the outer housing of the train. The biasing assembly is engaged to the brake arm for biasing the brake arm such that the brake pad disengages the upper portion of the associated track when the hydraulic piston is not actuated.

Figure 12:
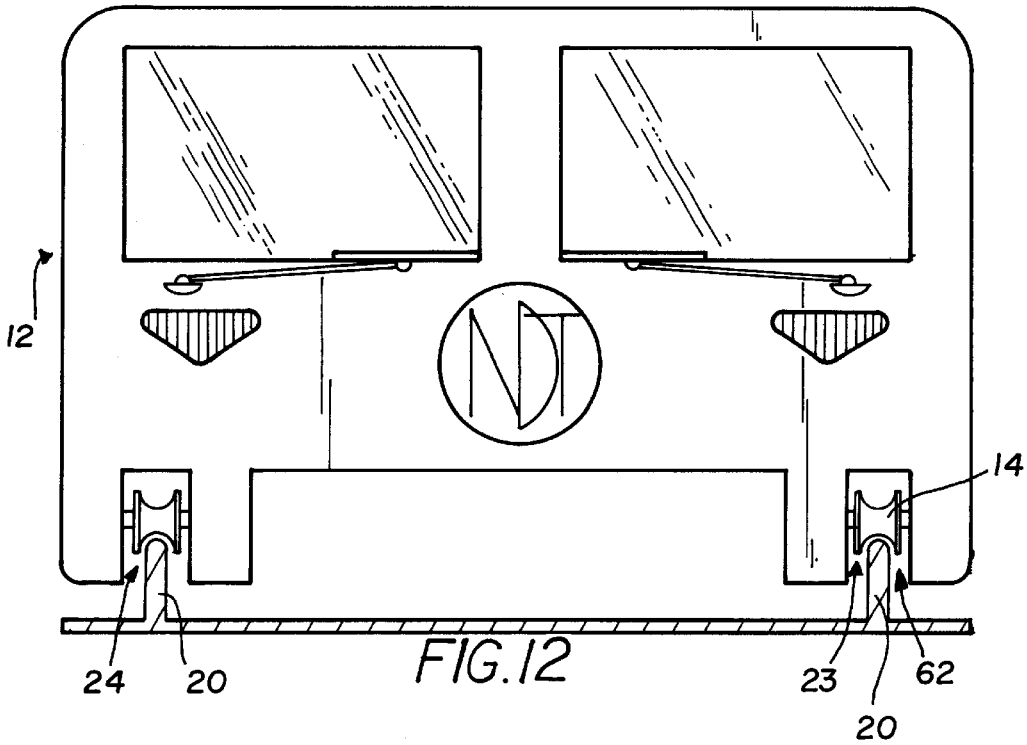
FIG. 12 is a front view of the present invention.
Figure 13:
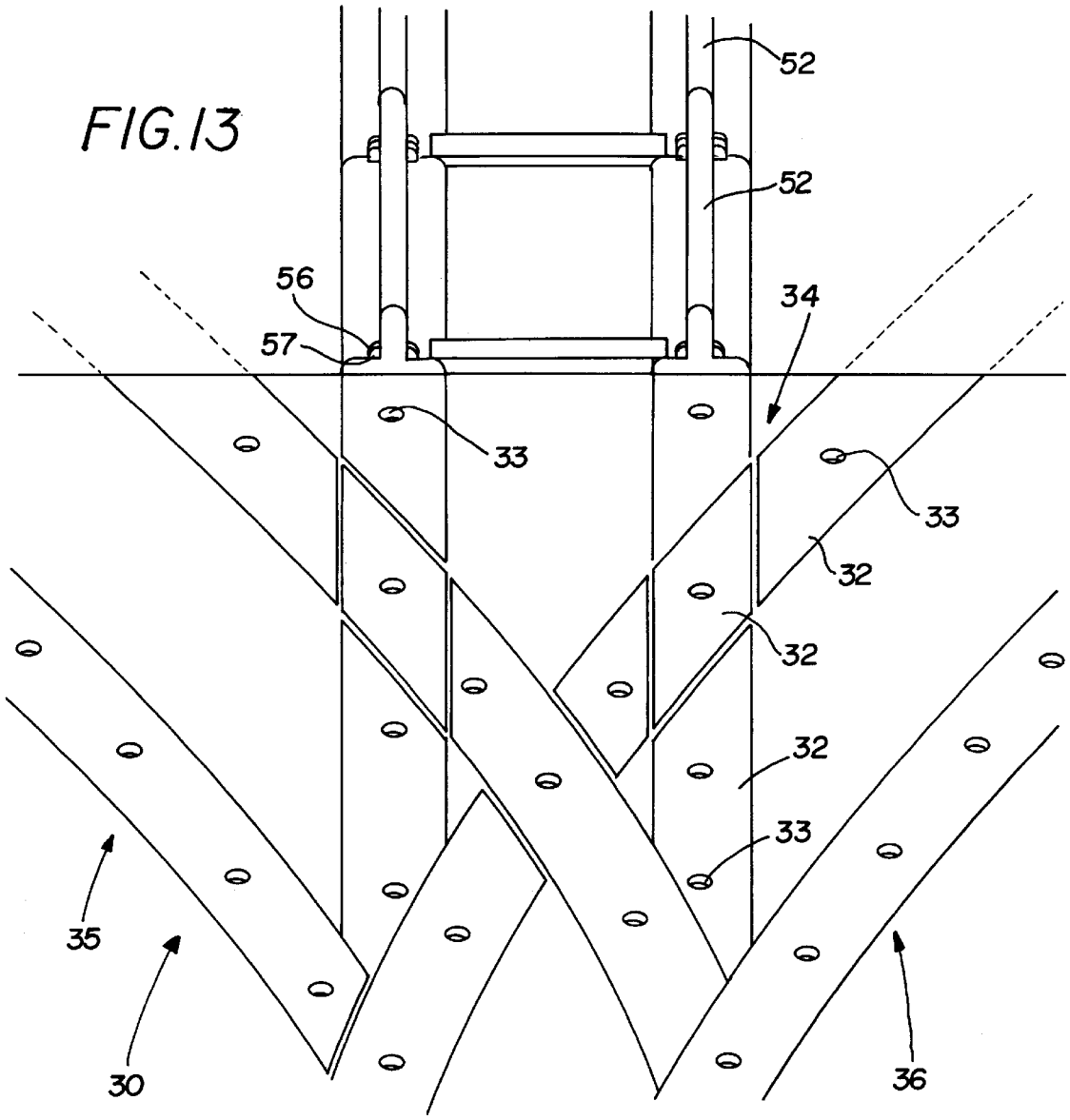
FIG. 13 is a front perspective view of a switching portion of the present invention.
Figure 14:
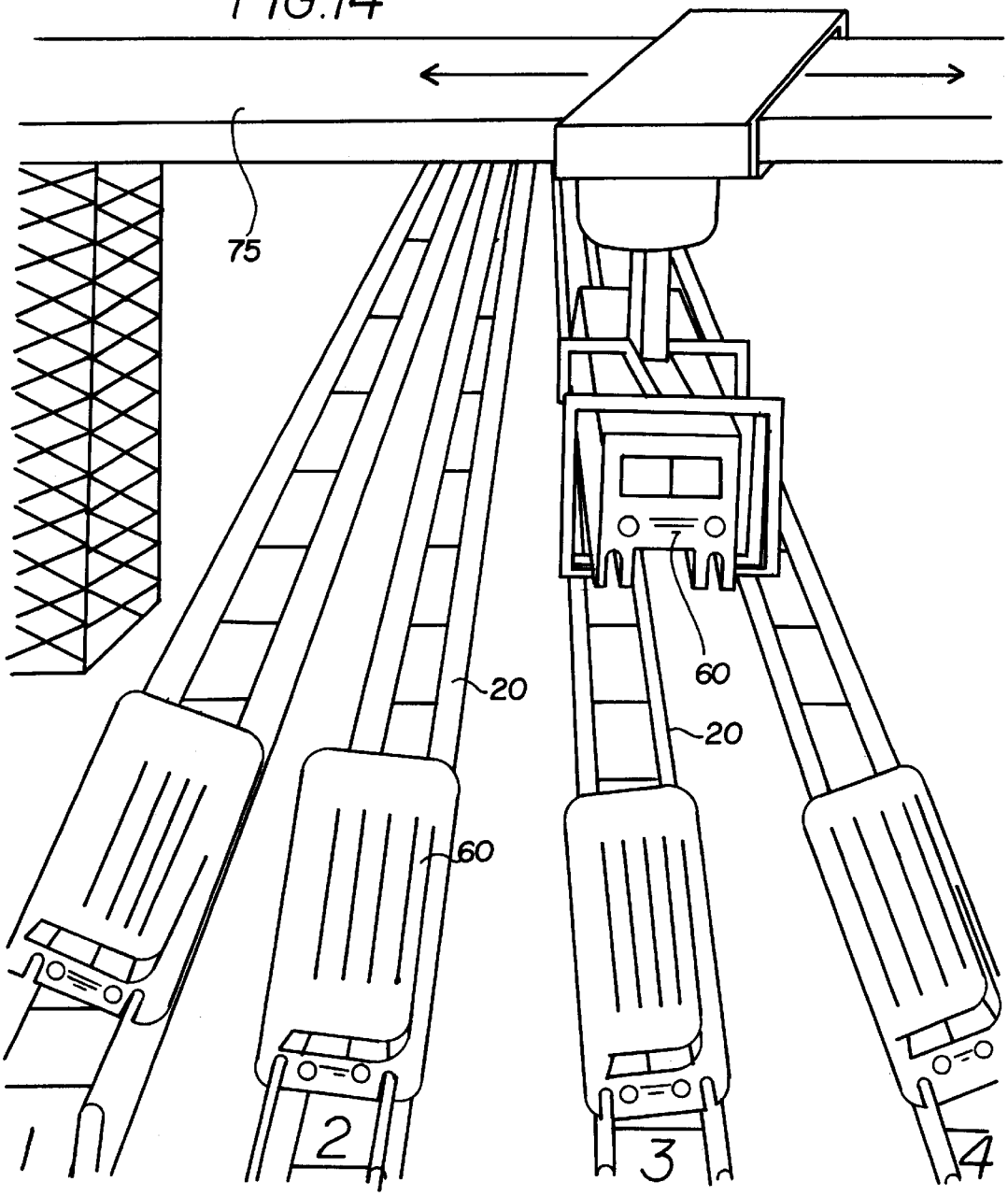
FIG. 14 is a front perspective view of an alternate track switching system of the present invention.
Figure 15:
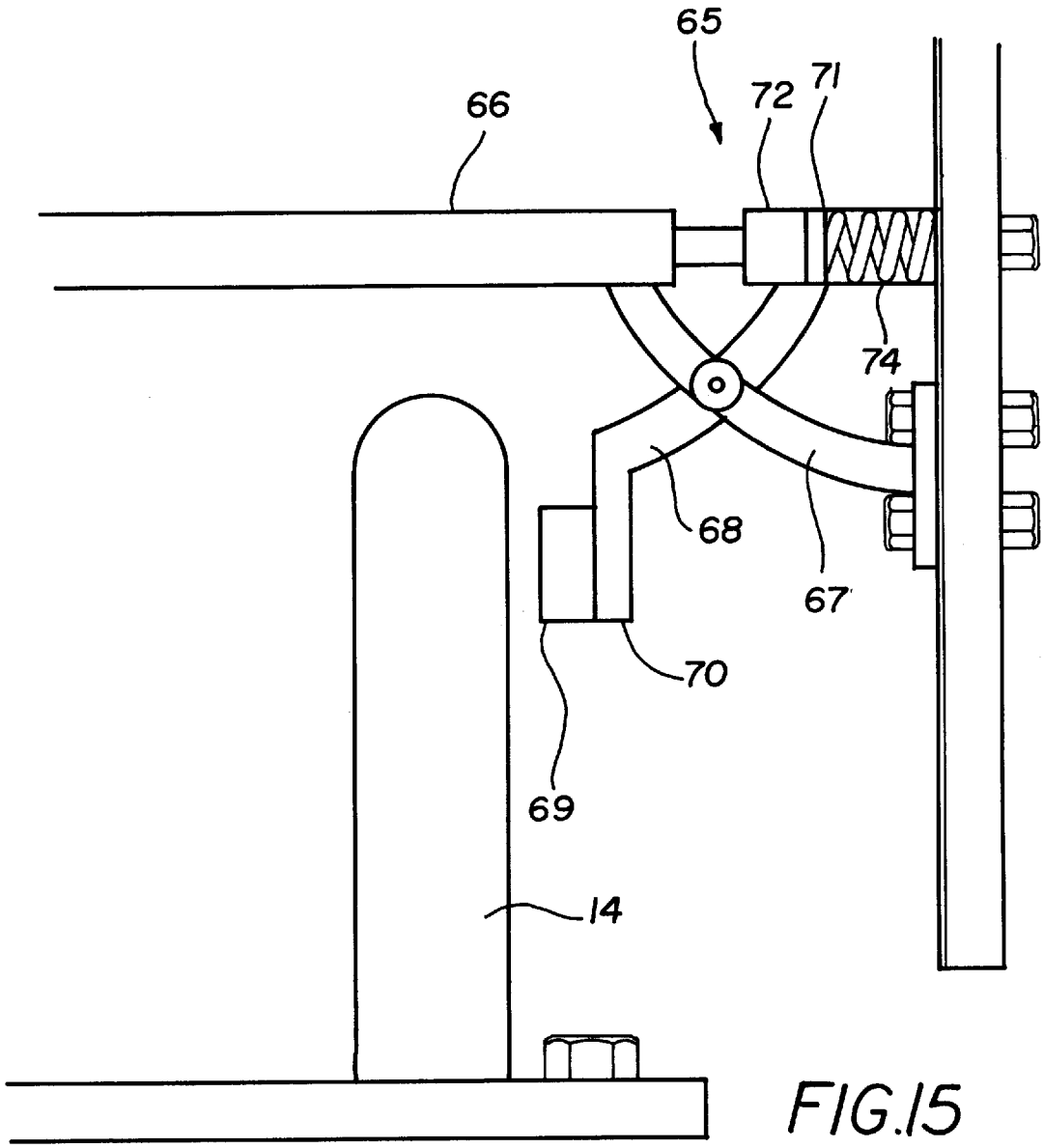
FIG. 15 is a front view of a braking assembly for the present invention.

In contrast to the switching portion, the tracks may be arranged to prevent crossing each other or otherwise sharing of one track by more than one train at a time for enhanced safety. To switch between separate tracks, a crane 75 is provided for positioning over a selected one of a set of parallel separate tracks. The crane is supported over the tracks for engaging and lifting a train from one track and setting the train on a selected separate track as shown in FIG. 12.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A train derailment prevention system comprising:

a train having a plurality of wheels, each wheel being generally disc shaped and having opposite sides and an outer perimeter wall extending between the opposite sides;

wherein said perimeter wall is arcuate such that said outer perimeter wall of each wheel is concave;

a pair of spaced tracks, each track having a convex upper surface insertable into said concave outer perimeter wall of each wheel whereby said wheel is prevented from moving laterally with respect to said track; and said plurality of wheels being divided into a first set of wheels and a second set of wheels, each of the set of wheels being aligned along a respective side of said train such that each of the set of wheels engages a respective one of said tracks when said train is positioned on said track;

an inner platform member having a substantially planar upper surface, said inner platform member being for positioning between said tracks;

a pair of outer platform members, said outer platform members being positioned on opposite outer sides of said pair of tracks in alignment with said inner platform member;

said inner platform member being adapted for elevating above a ground surface to a height such that said upper surface of said inner platform is positioned substantially in a plane extending between the upper surfaces of the tracks;

said outer platforms each having an interior edge positioned adjacent to a respective one of said tracks, said interior edge being adapted for being selectively elevated above the ground surface such that said interior edge of said outer platform is positioned adjacent to said upper surface of said respective track whereby said upper surface of said outer platform extends between the ground surface and said upper surface of said respective track for facilitating movement of a vehicle over said tracks.

2. The train derailment prevention system of claim 1 wherein each of said tracks is adapted to extend a distance above the ground surface sufficient to prevent the vehicle from crossing over said tracks when said outer and inner platforms are not in an elevated position.

3. The train derailment prevention system of claim 1, further comprising:

wherein each of said tracks is adapted to extend a distance above the ground surface sufficient to prevent the vehicle from crossing over said tracks when said outer and inner platforms are not in an elevated position;

wherein a track switching portion of said tracks comprises:

a plurality of base members, each of said base members having at least one aperture therein, said base members being arranged to define a first straight pair of parallel members, a second pair of parallel members diverging from the first pair of parallel members in a first direction, and a third pair of parallel members diverging from the first parallel members in a second direction opposite the first direction;

said track switching portion including a plurality of single track pieces, each of said single track pieces having an upper portion having a convex upper surface insertable into said concave outer perimeter wall of each wheel, each of said single track pieces further having at least one protrusion extending downwardly from a bottom surface of said track piece for insertion into said apertures of said base members such that said single track pieces are selectively arrangeable to define a single parallel pair of switching tracks along a selected one of said first, second and third parallel members;

a lifting hole extending through said upper portion of said single track piece adapted for permitting insertion of a tool through the lifting hole for facilitating movement of the single track piece to a different location in said track switching portion;

each single track piece having a plurality of connection portions, each connection portion having a generally cylindrical connection hole extending through the connection portion, each connection hole having a longitudinal axis parallel to a longitudinal axis of said upper portion of said track piece, said connection portions being alignable with said connection portions of an adjacently positioned single track piece for facilitating connection of said single track pieces by coupling a connecting member through said aligned connection holes whereby said adjacent single track pieces are coupled together;

said spaced tracks including a plurality of double track pieces, said double track pieces having a pair of upper portions, each upper portion of said double track pieces having a convex upper surface insertable into said concave outer perimeter wall of each wheel, said upper track portions of said double track pieces being coupled to each other by a plurality of spacing cross members integrally joined to said upper portions;

each double track piece having a plurality of connection portions, each connection portion having a generally cylindrical connection hole extending through the connection portion, each connection hole having a longitudinal axis parallel to a longitudinal axis of an associated one of said upper portions of said double track piece, said connection portions being alignable with said connection portions of an adjacently positioned double track piece for facilitating connection of said double track pieces by coupling a double track piece connecting member through said aligned connection holes whereby said adjacent double track pieces are coupled together;

wherein said adjacent double track pieces are aligned and coupled to each other such that a gap is formed between said adjacent double track pieces to permit expansion of said double track pieces due to changing temperature each train having a single car, each car having six wheels, three wheels positioned on each side of said car;

said car having an outer housing, said outer housing extending downwardly on opposite sides of each wheel to form a pair of wheel slots extending along a length of said car;

said wheels being positioned within said wheel slots such that said outer housing extends below said outer perimeter wall of said wheels whereby said wheel slots receiving a distal portion of said upper portion of said tracks when said train is positioned on said tracks;

said train having a brake assembly coupled to each side of said outer housing; and each brake assembly comprising a hydraulic piston coupled to a bracket member, said bracket member being coupled to said outer housing, a brake arm pivotally coupled to said bracket member, said brake arm having a brake pad coupled to a first end of said brake arm positioned proximate said upper portion of an associated one of said tracks positioned proximate said brake arm when said train is positioned on said tracks, a second end of said brake arm being engaged to an extendable head of said hydraulic piston such that extension of said head of said piston pivots said brake pad into contact with said upper portion of said associated track for slowing said train, and wherein each brake assembly further includes a biasing assembly coupled to the outer housing of the train, said biasing assembly being engaged to said brake arm for biasing said brake arm such that said brake pad disengages said upper portion of said associated track when said hydraulic piston is not actuated.

4. A train derailment prevention system comprising:

a train having a plurality of wheels, each wheel being generally disc shaped and having opposite sides and an outer perimeter wall extending between the opposite sides;

wherein said perimeter wall is arcuate such that said outer perimeter wall of each wheel is concave;

a pair of spaced tracks, each track having a convex upper surface insertable into said concave outer perimeter wall of each wheel whereby said wheel is prevented from moving laterally with respect to said track;

said plurality of wheels being divided into a first set of wheels and a second set of wheels, each of the set of wheels being aligned along a respective side of said train such that each set of wheels engages a respective one of said tracks when said train is positioned on said track;

a plurality of base members, each of said base members having at least one aperture therein, said base members being arranged to define a first straight pair of parallel members, a second pair of parallel members diverging from the first pair of parallel members in a first direction, and a third pair of parallel members diverging from the first parallel members in a second direction opposite the first direction.

5. The train derailment prevention system of claim 4, further comprising:

said track switching portion including a plurality of single track pieces, each of said single track pieces having an upper portion having a convex upper surface insertable into said concave outer perimeter wall of each wheel, each of said single track pieces further having at least one protrusion extending downwardly from a bottom surface of said track piece for insertion into said apertures of said base members such that said single track pieces are selectively arrangeable to define a single parallel pair of switching tracks along a selected one of said first, second and third parallel members.

6. The train derailment prevention system of claim 5, wherein each of said single track pieces further comprises:

a lifting hole extending through said upper portion of said single track piece adapted for permitting insertion of a tool through the lifting hole for facilitating movement of the single track piece to a different location in said track switching portion.

7. The train derailment prevention system of claim 5, further comprising:

each single track piece having a plurality of connection portions, each connection portion having a generally cylindrical connection hole extending through the connection portion, each connection hole having a longitudinal axis parallel to a longitudinal axis of said upper portion of said track piece, said connection portions being alignable with said connection portions of an adjacently positioned single track piece for facilitating connection of said single track pieces by coupling a connecting member through said aligned connection holes whereby said adjacent single track pieces are coupled together.

8. A train derailment prevention system comprising:

a train having a plurality of wheels, each wheel being generally disc shaped and having opposite sides and an outer perimeter wall extending between the opposite sides;

wherein said perimeter wall is arcuate such that said outer perimeter wall of each wheel is concave;

a pair of spaced tracks, each track having a convex upper surface insertable into said concave outer perimeter wall of each wheel whereby said wheel is prevented from moving laterally with respect to said track;

said plurality of wheels being divided into a first set of wheels and a second set of wheels, each set of wheels being aligned along a respective side of said train such that each of the set of wheels engages a respective one of said tracks when said train is positioned on said track;

said spaced tracks including a plurality of double track pieces, said double track pieces having a pair of upper portions, each upper portion of said double track pieces having a convex upper surface insertable into said concave outer perimeter wall of each wheel, said upper track portions of said double track pieces being coupled to each other by a plurality of spacing cross members integrally joined to said upper portions.

9. The train derailment prevention system of claim 8, further comprising:

each double track piece having a plurality of connection portions, each connection portion having a generally cylindrical connection hole extending through the connection portion, each connection hole having a longitudinal axis parallel to a longitudinal axis of an associated one of said upper portions of said double track piece, said connection portions being alignable with connection portions of an adjacently positioned double track piece for facilitating connection of said double track pieces by coupling a connecting member through said aligned connection holes whereby said adjacent double track pieces are coupled together.

10. The train derailment prevention system of claim 9 wherein said adjacent double track pieces are aligned and coupled to each other such that a gap is formed between said adjacent double track pieces to permit expansion of said double track pieces due to changing temperature.

11. A train derailment prevention system comprising:

a train having a plurality of wheels, each wheel being generally disc shaped and having opposite sides and an outer perimeter wall extending between the opposite sides;

wherein said perimeter wall is arcuate such that said outer perimeter wall of each wheel is concave;

a pair of spaced tracks, each track having a convex upper surface insertable into said concave outer perimeter wall of each wheel whereby said wheel is prevented from moving laterally with respect to said track;

said plurality of wheels being divided into a first set of wheels and a second set of wheels, each of the set of wheels being aligned along a respective side of said train such that each of the set of wheels engages a respective one of said tracks when said train is positioned on said track;

said train including a plurality of cars, each car having an outer housing, said outer housing extending downwardly on opposite sides of each wheel to form a pair of wheel slots extending along a length of said car;

said wheels being positioned within said wheel slots such that said outer housing extends below said outer perimeter wall of said wheels whereby said wheel slots receiving a distal portion of said upper portion of said tracks when said train is positioned on said tracks.

12. The train derailment system of claim 11, further comprising:

said train having a brake assembly coupled to each side of said outer housing;

each brake assembly comprising a hydraulic piston coupled to a bracket member, said bracket member being coupled to said outer housing, a brake arm pivotally coupled to said bracket member, said brake arm having a brake pad coupled to a first end of said brake arm positioned proximate said upper portion of an associated one of said tracks when said train is positioned on said tracks, a second end of said brake arm being engaged to an extendable head of said hydraulic piston such that extension of said head of said piston pivots said brake pad into contact with said upper portion of said associated track for slowing said train.

13. The train derailment system of claim 12 wherein each brake assembly further includes a biasing assembly coupled to the outer housing of the train, said biasing assembly being engaged to said brake arm for biasing said brake arm such that said brake pad disengages said upper portion of said associated track when said hydraulic piston is not actuated.

14. A train derailment prevention system comprising:

a train having a plurality of wheels, each wheel being generally disc shaped and having opposite sides and an outer perimeter wall extending between the opposite sides;

wherein said perimeter wall is arcuate such that said outer perimeter wall of each wheel is concave;

a pair of spaced tracks, each track having a convex upper surface insertable into said concave outer perimeter wall of each wheel whereby said wheel is prevented from moving laterally with respect to said track;

said plurality of wheels being divided into a first set of wheels and a second set of wheels, each of the set of wheels being aligned along a respective side of said train such that each of the set of wheels engages a respective one of said tracks when said train is positioned on said track;

each train having a single car, each car having six wheels, three wheels positioned on each side of said car;

said car having an outer housing, said outer housing extending downwardly on opposite sides of each wheel to form a pair of wheel slots extending along a length of said car;

said wheels being positioned within said wheel slots such that said outer housing extends below said outer perimeter wall of said wheels whereby said wheel slots receiving a distal portion of said upper portion of said tracks when said train is positioned on said tracks.

* * * * *